US007197775B2

(12) United States Patent
Steadman

(10) Patent No.: US 7,197,775 B2
(45) Date of Patent: Apr. 3, 2007

(54) BATH LIFT

(76) Inventor: William Steadman, 7858 Meadow Lark La., Port Saint Lucie, FL (US) 34952

( * ) Notice: Subject to any disclaimer, the term of this patent is extended or adjusted under 35 U.S.C. 154(b) by 302 days.

(21) Appl. No.: 10/990,077

(22) Filed: Nov. 16, 2004

(65) Prior Publication Data

US 2006/0101574 A1 May 18, 2006

(51) Int. Cl.
*A47K 3/02* (2006.01)

(52) U.S. Cl. ..... 4/562.1; 4/561.1

(58) Field of Classification Search ..... 4/560.1–566.1, 4/667

See application file for complete search history.

(56) References Cited

U.S. PATENT DOCUMENTS

| | | | | |
|---|---|---|---|---|
| 3,268,918 | A | 8/1966 | Batty et al. | |
| 3,465,371 | A * | 9/1969 | Schweitzer | 4/561.1 |
| 3,579,660 | A * | 5/1971 | Whitaker | 4/564.1 |
| 3,714,672 | A * | 2/1973 | Condon | 4/563.1 |
| 3,730,176 | A | 5/1973 | Miller | |
| 3,815,163 | A | 6/1974 | Sullivan | |
| 3,852,835 | A * | 12/1974 | Whitaker | 4/562.1 |
| 3,925,833 | A * | 12/1975 | Hunter | 4/667 |
| 3,983,584 | A | 10/1976 | Holecek | |
| 4,028,745 | A | 6/1977 | Caniglia | |
| 4,091,478 | A * | 5/1978 | Hardwick et al. | 4/562.1 |
| 4,598,432 | A | 7/1986 | Pennington-Richards | |
| 4,606,082 | A * | 8/1986 | Kuhlman | 4/561.1 |
| 4,633,538 | A | 1/1987 | James | |
| 4,709,426 | A | 12/1987 | Godwin, Jr. | |
| 4,712,788 | A | 12/1987 | Gaudreau, Jr. | |
| 4,733,418 | A | 3/1988 | Luther | |
| 4,928,330 | A | 5/1990 | Moore | |
| 4,951,328 | A | 8/1990 | Potvin | |
| 5,129,112 | A | 7/1992 | Schaffer | |
| 5,146,638 | A | 9/1992 | Richards | |
| 5,201,084 | A | 4/1993 | Johnson | |
| 5,263,207 | A | 11/1993 | Gilbert | |
| 5,279,004 | A | 1/1994 | Walker | |
| 5,329,651 | A | 7/1994 | Mardero et al. | |
| 5,465,433 | A | 11/1995 | Nolan | |
| 5,477,574 | A | 12/1995 | Skoe | |
| 5,715,545 | A | 2/1998 | Forwick | |
| 5,924,147 | A | 7/1999 | Clark et al. | |
| 6,003,168 | A | 12/1999 | Steadman | |
| D437,467 | S | 2/2001 | Steadman | |
| 6,256,807 | B1 | 7/2001 | Steadman | |
| 6,397,410 | B1 | 6/2002 | Steadman | |
| 2004/0139542 | A1* | 7/2004 | Crane | 4/561.1 |

FOREIGN PATENT DOCUMENTS

| | | |
|---|---|---|
| DE | 3002149 | 7/1981 |
| GB | 2123285 | 7/1982 |
| GB | 2315733 | 2/1998 |

* cited by examiner

*Primary Examiner*—Khoa D. Huynh
(74) *Attorney, Agent, or Firm*—Tarolli, Sundheim, Covell & Tummino LLP

(57) ABSTRACT

A bath lift apparatus locatable near a bath to raise or lower a person sitting thereon. The lift apparatus features a support for positioning on the floor and a canopy mounted above the bathtub. Extending from the support is an arm capable of both translation and rotation, from which, a chair is attached. Located within the canopy is a prime mover that is connected to the arm and provides lifting force for the chair and occupant when the lift is assembled and in use to elevate a user from and into the bath.

16 Claims, 4 Drawing Sheets

BATH LIFT

FIELD OF THE INVENTION

This invention relates to bath lifts and more particularly to that class of bath lifts that can be installed to function with a standard household bath tub.

BACKGROUND

Bath lifts that are constructed to be installed in residential dwellings to be used with conventional bathtubs are well known. Patents issued to the patentee of this disclosure, and such examples include U.S. Pat. Nos. 6,003.168 and 6,397,410.

While bath lifts of the type represented by the referenced patents have enjoyed commercial success, prior known constructions suitable for installation in a conventional bath without significant remodeling have been limited to persons weighing of the order of 250 pounds or less.

SUMMARY OF THE DISCLOSURE

A bath lift made in accordance with the present disclosure may be installed in a typical residential bath room without remodeling the room. The lift of the present disclosure is capable of positioning persons weighing up to 350 pounds and perhaps more in a bath and subsequently lifting such a large person from a bath.

A bath lift of the present disclosure includes a canopy that is positioned over a tub. A floor mounted post supports the canopy near the side of the tub over which a person enters and leaves a bath. The canopy is elevated over and spans the tub. An end of the canopy remote from the post is supported in position to maintain the canopy in an elevated condition. The remote end support is typically by connection to a building wall adjacent the tub.

A users chair is reciprocally and rotatably mounted on the post. The chair is moveable from a user mounting and discharge position adjacent the tub to a bathing position where a user is positioned partially within bath water in the tub. When a person is to enter a bath, the chair is positioned in an enter/exit position outboard of the tub in a lowered condition. Once the person is on the chair the chair is elevated and then rotated about an axis of the post until the person is above a bathing location. The chair is then lowered to a bathing position wherein the user is at least partially immersed in bath water. Upon conclusion of bathing the chair is elevated, rotated and lowered to return the bather to the enter/exit positioned.

The raising and lowering of the chair is accomplished with a prime mover positioned within the canopy. The disclosed prime mover is a fluid cylinder, which acts against a section of a chair supporting cable. A pulley arrangement guides the cable between the chair and the cylinder.

The chair has a normal or rest position above the bath. Rotation of the chair from the rest position is accomplished by pulling on a rope extending between the seat of the chair and the post. When the chair is rotated from the rest position to a position outboard of the side of the bathtub it simultaneously is lowered. As a consequence, if one releases the rope the chair will be gravity biased from the outboard position to the rest position. When a user is to sit on the chair, the chair is moved to the outboard position by pulling on the rope and then lowered to the enter/exit position outboard of the side of the bathtub.

Accordingly, the objects of the invention are to provide a novel and improved bath lift and a method of using a bath lift.

DETAILED DESCRIPTION OF PREFERRED EMBODIMENTS

Figure 1:
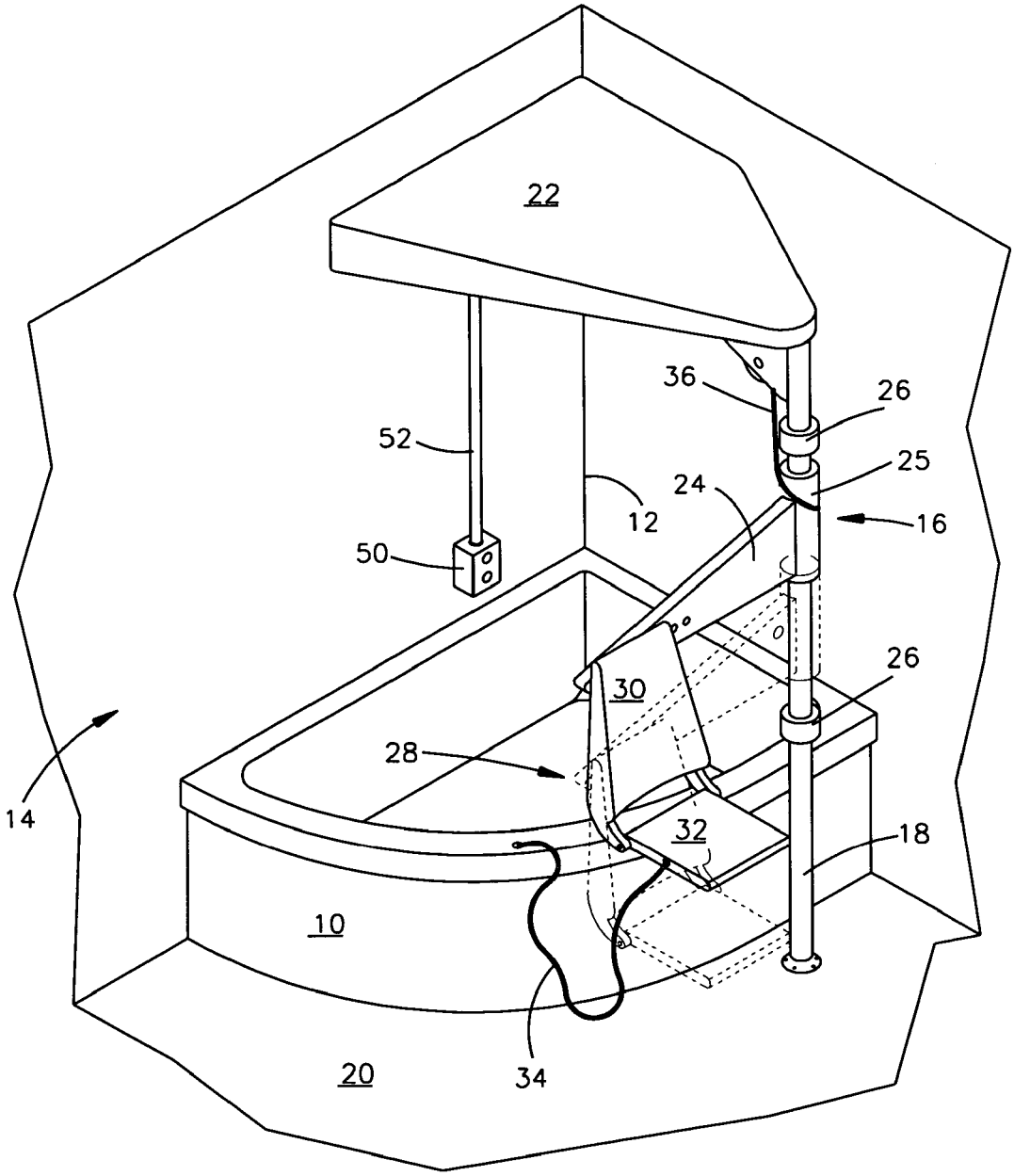
FIG. 1 is a perspective view of a section of a bath room equipped with the lift of the present disclosure with the chair in its outboard position shown in solid lines and its enter/exit position in phantom.
Figure 2:
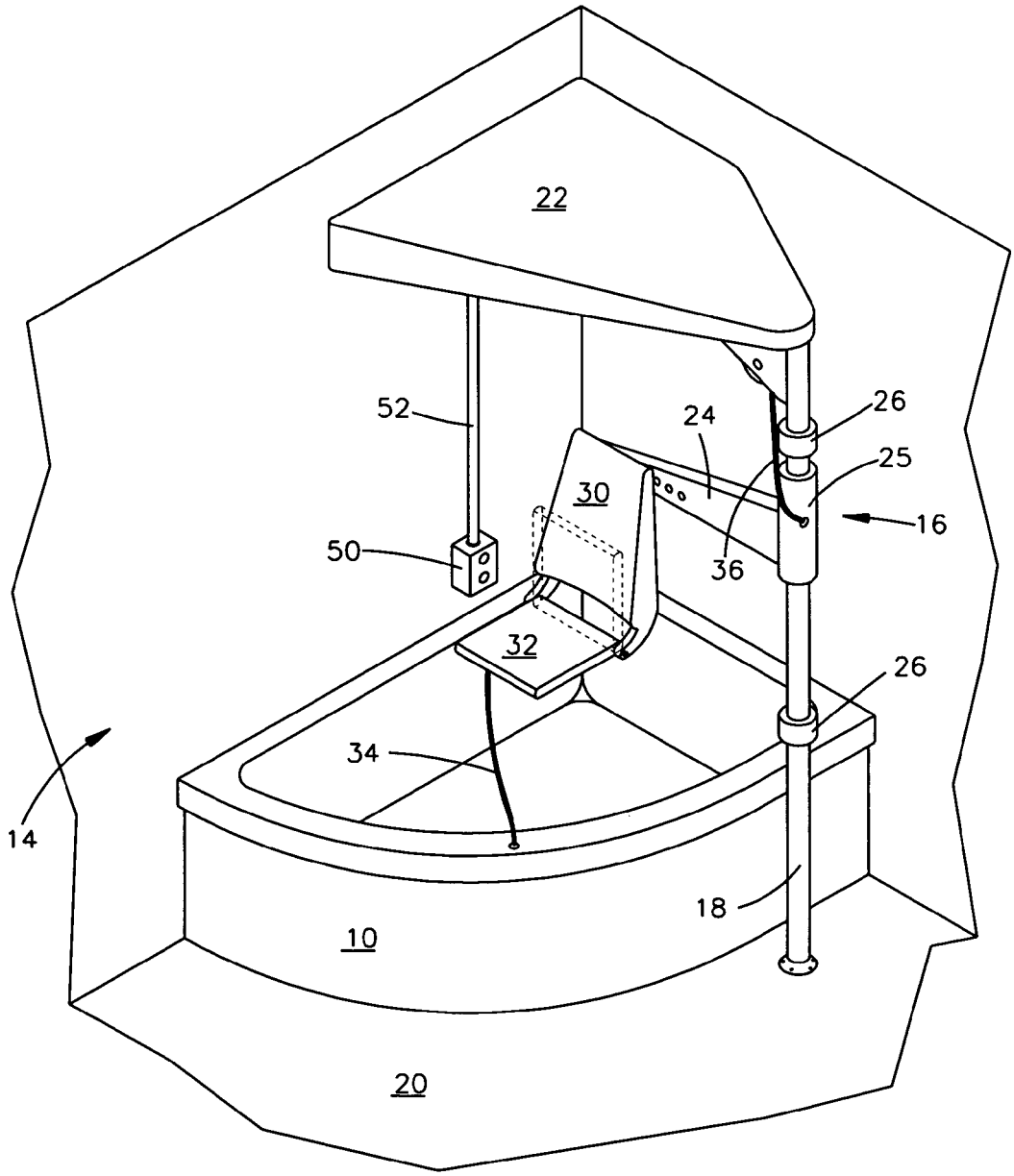
FIG. 2 is a view of the room of FIG. 1 with the chair in its rest position.
Figure 3:
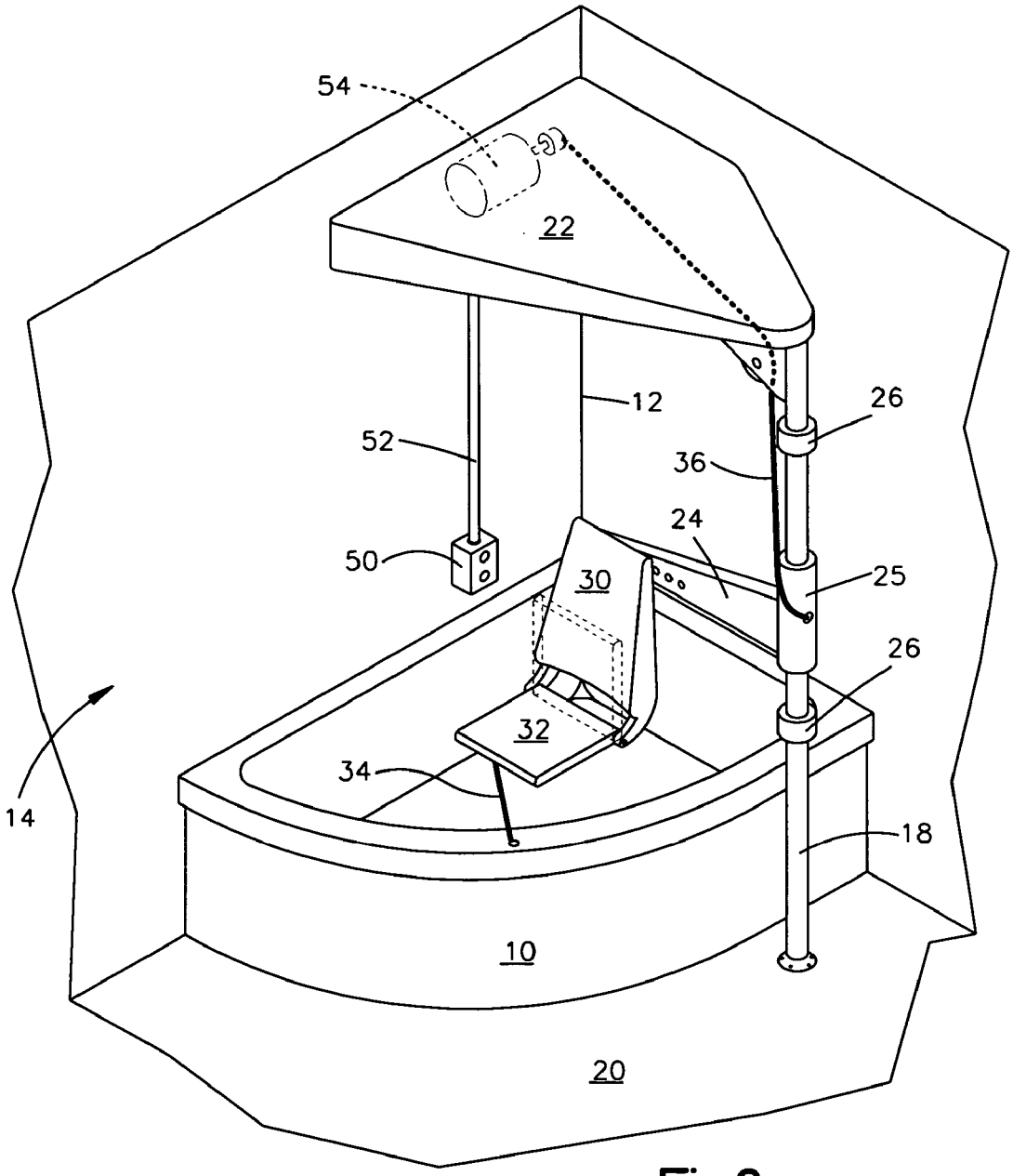
FIG. 3 is a view of the room of FIG. 1 with the chair in its bathing position and illustrating in phantom that the chair seat may be pivoted upwardly to a storage position.

Referring now to the drawings and to FIGS. 1–3 in particular, a bath tub 10 is shown positioned in a corner 12 of a bathroom 14. A bath lift assembly 16 is positioned to transport persons into and remove them from the tub 10.

The assembly includes a support in the form of a post 18 extending upward from a floor 20 to a canopy 22. The canopy is supported by the post 18 and a connection (not shown) to the wall 14. A chair support arm 24 is provided. The arm 24 is secured to and projects from a guide tube 25. The guide tube is journaled on the post 18 for both rotative and reciprocal movement relative to the post. Vertical travel of the guide tube 25 relative to the support 18 is limited by a spaced pair of travel limiters 26 mounted on the support.

A chair 28 is secured to and depends from the arm 24. The chair 28 includes a back 30 connected to and depending from the arm 24. A chair seat 32 is pivotally connected to the back 30 for movement between a person support position shown in solid lines in FIGS. 1 through 3 and a storage position shown in phantom in FIG. 2.

A tether 34 extends between the chair 28 and the tub 10. The tether is used by a bather or bather's assistant to move the chair between a rest position of FIG. 2 over the bath and to a load/unload position adjacent the bath, as seen in phantom in FIG. 1. A flexible support cable 36 extends between the canopy 22 and the arm 24. As will be seen by a comparative examination of FIGS. 1 and 2, when one pulls on the tether 34 the arm is rotated from the rest position of FIG. 2 to the position of FIG. 1, the cable 36 is augmented. Foreshortening of the cable 36 elevates the arm and the chair when one releases the tether the chair will be gravity biased from the position of FIG. 1 to the position of FIG. 2. The cable 36 is foreshortened by wrapping about the post 18.

Figure 5:
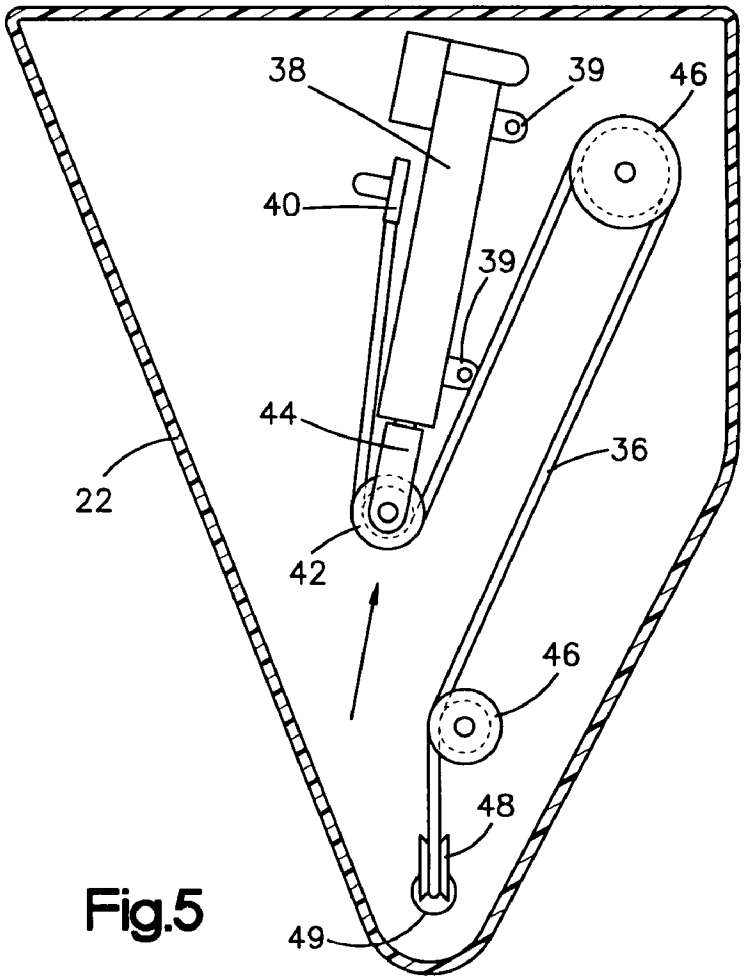
Figure 4:
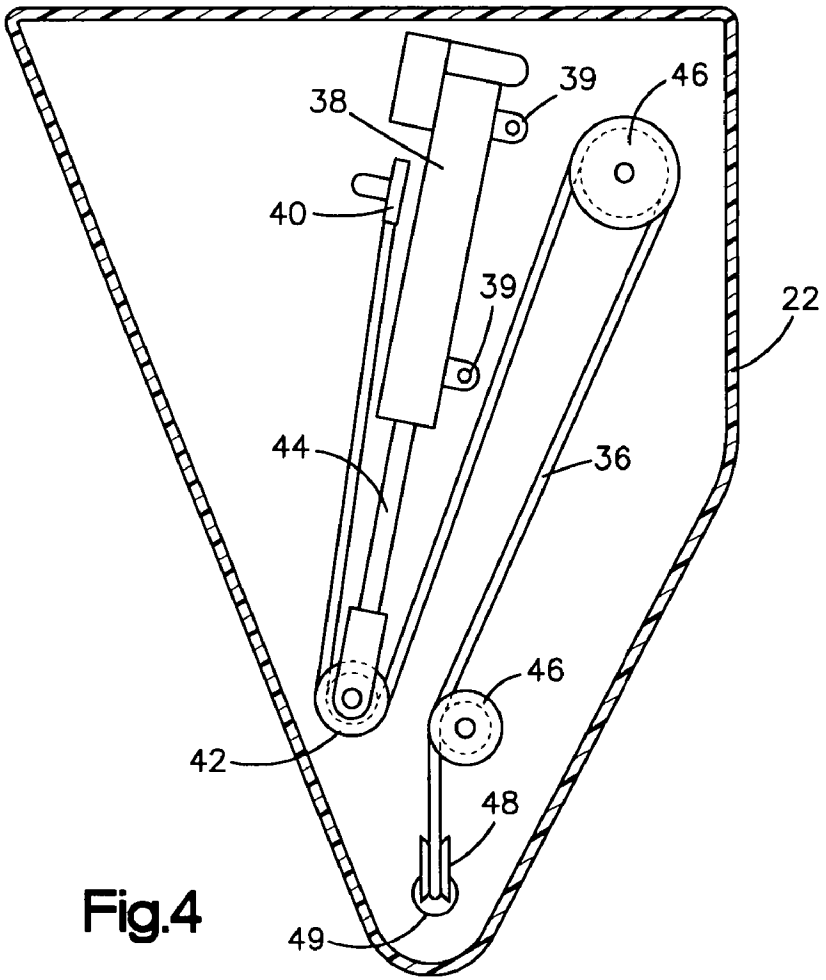
FIG. 4 is a plan view of the canopy and the chair raising and lowering mechanism in a chair raised condition; and, FIG. 5 is a view corresponding to FIG. 4 with the mechanism in a chair lowered position.

Referring now to FIGS. 4 and 5, a mechanism for controlling the height of the chair 28 is shown. The mechanism includes a prime mover in the form of a cylinder 38 secured to the canopy 22 by fasteners 39. The cable has a bitter end anchored at 40. The cable is reeved around a pulley 42 mounted on a remote end of a rod 44. The cable is then reeved around a pair of idler pulleys 46. The pulleys of the pair 46 are mounted in the canopy for rotation about vertical axis. The cable 36 is configured within the canopy by passing over a horizontal axis pulley 48 and thence through an exit orifice 49 in the canopy.

As fluid under pressure is introduced into the cylinder 38, the rod 44 is extended to the position of FIG. 4. The extension of the rod foreshortens the cable to elevate the chair from the bathing position of FIG. 3 to the rest position of FIG. 2. As fluid is removed from the cylinder 38, the weight of the arm 24 and the chair 28 will tension the cable and result in the chair descending from the rest position of FIG. 2 to the bathing position of FIG. 3.

Referring again to FIG. 1, an operator accessible control switch 50 is provided. The switch 50 is suspended from the canopy by a cable 52. The switch is provided to control a known source of fluid under pressure, not shown. Alternately the switch may control an electric motor 54 shown schematically in the canopy 22 in FIG. 3. The motor 54 is an alternate to the cylinder as a prime mover to drive a lead screw with the pulley arrangement of FIGS. 4 and 5 or a winch upon which portions of the cable 36 may be wound in a known manner.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What I claim is:

1. A kit for assembling a bath lift for use with a bathtub mounted on a floor of a building, said bathtub having sides forming a bathing area, said kit comprising:

a) a cylindrical tube having an upper portion and an opposite lower portion for positioning on the floor of the building in an upstanding orientation when in use;

b) a canopy having an interior chamber, the canopy for mounting above the bathing area of the bathtub when in use, the canopy having a first end adapted to be mounted when in use to the upper portion of the cylindrical tube;

c) the canopy also having an opposite second end spaced from the first end for direct connection to the building whereby the canopy when in use maintains and stabilizes the upper portion of the cylindrical tube in its installed place;

d) a support arm for mounting on the cylindrical tube when in use, the arm when so mounted being moveable relative to the cylindrical tube of both vertically and rotationally;

e) a chair carried by the arm when the lift is assembled;

f) a prime mover for mounting within the interior chamber of the canopy and providing lifting force for the chair and an occupant when the lift is assembled and in use to elevate the occupant from a bath; and, g) structure interconnecting the prime mover and the arm for supporting the arm on the cylindrical tube;

wherein the cylindrical tube, when assembled and in use, is mounted on the floor adjacent an outer surface of one of the sides of the bathtub.

2. The kit of claim 1 wherein said structure is a flexible cable.

3. A bath lift comprising an assembly of the kit of claim 1.

4. The lift of claim 3 further including a means for rotating the arm about the cylindrical tube for shifting the chair between a bathing area over a bathing section of the tub and a load/unload position adjacent a side of the sides of the tub.

5. The lift of claim 3 further including means for causing movement of the chair between a bath enter/exit position over such water and an on/off position near the side of the tub.

6. The lift of claim 5 wherein the positioning means for causing movment is a tether.

7. The lift of claim 6 wherein said structure is a flexible cable depending from a canopy location to a connection to the chair and wherein the location and connection are vertically aligned when the chair is positioned for lowering into and elevation out of the tub the cable depends vertically from the canopy location.

8. A bath lift for use with a bathtub mounted on a floor of a building, said bathtub having sides forming a bathing area, comprising;

a) a cylindrical tube having an upper portion and an opposite lower portion mountable on the floor of the building, the cylindrical tube being mounted on the floor adjacent an outer surface of one of the sides of the bathtub;

b) a canopy having an interior chamber, a first end mounted onto the upper portion of the cylindrical tube, an opposite second end spaced from the first end for direct connection to the building to maintain and stabilize the upper portion of the cylindrical tube, wherein the canopy is supported by the cylindrical tube and connected directly to the building such that the canopy is mounted above the bathing area of the bathtub, a prime mover is housed in the interior chamber of the canopy;

c) an arm journaled on the cylindrical tube for vertical reciprocal and rotational movements over a range of movements;

d) a chair connected to and supported by the arm; and, e) a cable connected to the prime mover and the arm for supporting the arm and chair throughout the range of the movements between a bather transport elevation and a lower bathing elevation in bath water in the tub.

9. The lift of claim 8 wherein the cable depends from the canopy at a location vertically aligned with the connection of the cable to the arm when the arm is at the bathing elevation.

10. The lift of claim 8 further including means for causing movement of the chair between a bath enter/exit position over such water and an on/off position near a side of the tub.

11. The lift of claim 8 further including a prime mover control suspended from the canopy and being user accessible when a user is seated on the chair.

12. The lift of claim 11 wherein the prime mover is an electric motor and the control includes a flexible cable.

13. The lift of claim 12 further including an elevation limiter mounted on the cylindrical tube for stopping the motor when the arm reaches a predetermined height limit.

14. The lift of claim 8 wherein a pair of travel limiters are provided.

15. The lift of claim 14 wherein each travel limiter is a collar mounted on the cylindrical tube.

16. The bath lift of claim 8, wherein said prime mover is a cylinder coupled to a series of pulleys through said structure.

* * * * *